US012492557B2

(12) United States Patent
Mutter et al.

(10) Patent No.: US 12,492,557 B2
(45) Date of Patent: Dec. 9, 2025

(54) FLAME, EMBER AND RAIN RESISTANT VENT INSERTS FOR ROOF VENTS

(71) Applicant: William Boone Daniels, II, Henderson, NV (US)

(72) Inventors: David S. Mutter, Santa Rosa, CA (US); Gregory S. Daniels, Santa Rosa, CA (US); William B. Daniels, II, Las Vegas, NV (US)

(73) Assignee: William B. Daniels, II, Henderson, NV (US)

( * ) Notice: Subject to any disclaimer, the term of this patent is extended or adjusted under 35 U.S.C. 154(b) by 186 days.

(21) Appl. No.: 18/412,512

(22) Filed: Jan. 13, 2024

(65) Prior Publication Data

US 2025/0230655 A1 Jul. 17, 2025

(51) Int. Cl.

| | |
|---|---|
| ***E04D 1/30*** | (2006.01) |
| ***E04D 13/17*** | (2006.01) |
| ***F24F 7/02*** | (2006.01) |

(52) U.S. Cl.

CPC ..... *E04D 1/30* (2013.01); *E04D 13/17* (2013.01); *F24F 7/02* (2013.01); *E04D 2001/309* (2013.01)

(58) Field of Classification Search

CPC ..... E04D 1/30; E04D 13/17; E04D 2001/309; F24F 7/02

See application file for complete search history.

(56) References Cited

U.S. PATENT DOCUMENTS

| | | | | | |
|---|---|---|---|---|---|
| 2,300,842 | A * | 11/1942 | Leslie | F24F 7/02 | 454/366 |
| 2,490,220 | A * | 12/1949 | Leslie | E04D 13/17 | 454/366 |
| 2,551,223 | A * | 5/1951 | Schneider | F24F 7/02 | 454/366 |
| 2,628,551 | A * | 2/1953 | Leigh | F24F 7/02 | 454/366 |
| 5,662,522 | A * | 9/1997 | Waltz | F24F 7/02 | 454/367 |
| 6,308,473 | B1 * | 10/2001 | Auck | F24F 7/02 | 454/366 |
| 6,805,627 | B2 * | 10/2004 | Marts | F24F 13/082 | 454/367 |
| D549,316 | S * | 8/2007 | O'Hagin | D23/393 | |
| 8,782,967 | B2 * | 7/2014 | Daniels | F24F 7/02 | 52/302.1 |
| D841,797 | S * | 2/2019 | Daniels | D23/393 | |
| 10,487,512 | B2 * | 11/2019 | Bourque | F24F 7/02 | |
| 10,852,016 | B2 * | 12/2020 | Bourque | B01D 46/00 | |
| 11,326,793 | B2 * | 5/2022 | Daniels | E04D 1/30 | |
| 2005/0233691 | A1 * | 10/2005 | Horton | E04D 13/17 | 454/366 |

* cited by examiner

*Primary Examiner* — Adriana Figueroa
(74) *Attorney, Agent, or Firm* — Paul J. Backofen, Esq.

(57) ABSTRACT

The devices and methods described below provide for flame, ember and rain resistant vent inserts for existing installed roof vents that do not require breaking the weather resistant membrane of the roof or create damage to the surrounding building materials to install.

16 Claims, 8 Drawing Sheets

FLAME, EMBER AND RAIN RESISTANT VENT INSERTS FOR ROOF VENTS

FIELD OF THE INVENTIONS

The inventions described below relate to the field of flame, ember and weather resistant retrofit assemblies for installed roof vents.

BACKGROUND OF THE INVENTIONS

Energy efficiency is a serious consideration in every building. Residential buildings require attic ventilation systems to minimize heat and moisture buildup within attics. However, as attic ventilation technology improves building with existing "old-technology" ventilation systems hesitate to break the moisture barrier of their roof to replace the vents when improvements are available, it is often less expensive to replace the entire roof as well as the vents than to try and remove and replace old vents and then reseal the roof. In areas with extreme weather, rain, fire and embers, these undesirable elements are often driven into and through attic ventilation systems causing damage to the building, sometimes completely destroying it. This is a positive motivation to replace outdated ventilation technology, unfortunately replacing a roof is expensive and they generally last 20 or more years depending on the materials used and the skill of the installer. Thus, there is a huge installed base of roofs with old technology vents that should be upgraded to include the latest in weather, fire and ember resistance.

SUMMARY

The devices and methods described below provide for flame, ember and rain resistant vent inserts for existing installed roof vents that do not require breaking the weather resistant membrane of the roof or create damage to the surrounding building materials to install.

DETAILED DESCRIPTION OF THE INVENTIONS

Figure 1:
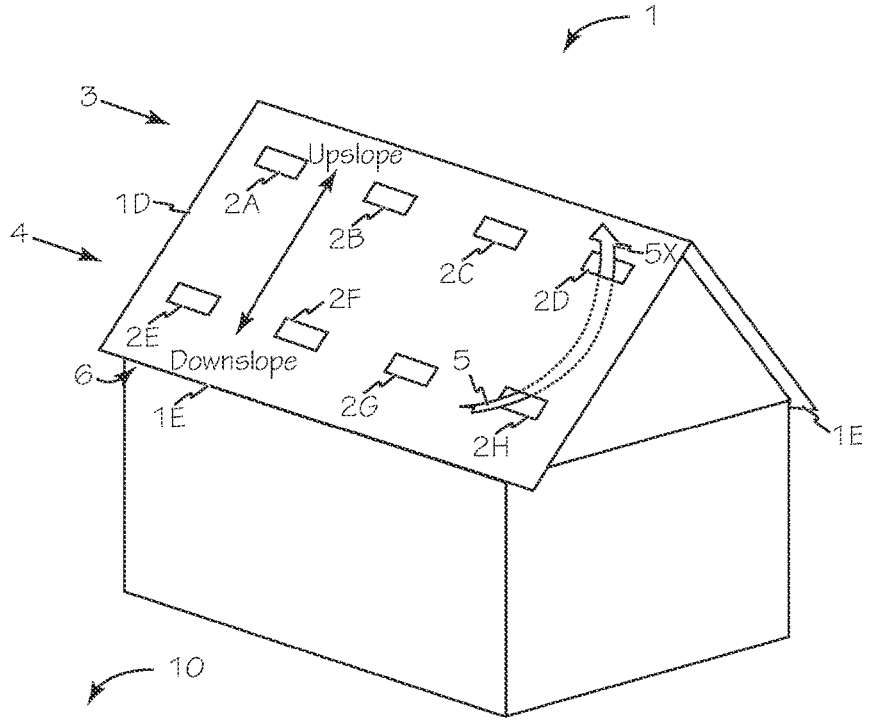
FIG. 1 is a simplified perspective view of a building with ventilation through the roof.

Buildings such as building 1 of FIG. 1 have one or more ventilation apertures, such as apertures 2A-2H, through the roof deck 1D to permit ventilation of the attic of the building. The ventilation apertures on the roof may be arranged with some apertures higher and or lower on the roof to optimize passive ventilation of the building. For example, the upper or upslope apertures 3 such as apertures 2A-2D are oriented high on the roof, upslope from the lower or downslope apertures 4, such as apertures 2E-2H. This orientation permits passive air circulation, convection, with outside air 5 entering the lower apertures and exiting the upper apertures as exhaust air 5X carrying heat and moisture from within the attic. Lower apertures may be located through the roof deck or alternatively or in addition to having lower apertures on the roof deck one or more additional eave apertures 6 may be included under the eaves 1E of the building.

Figure 2:
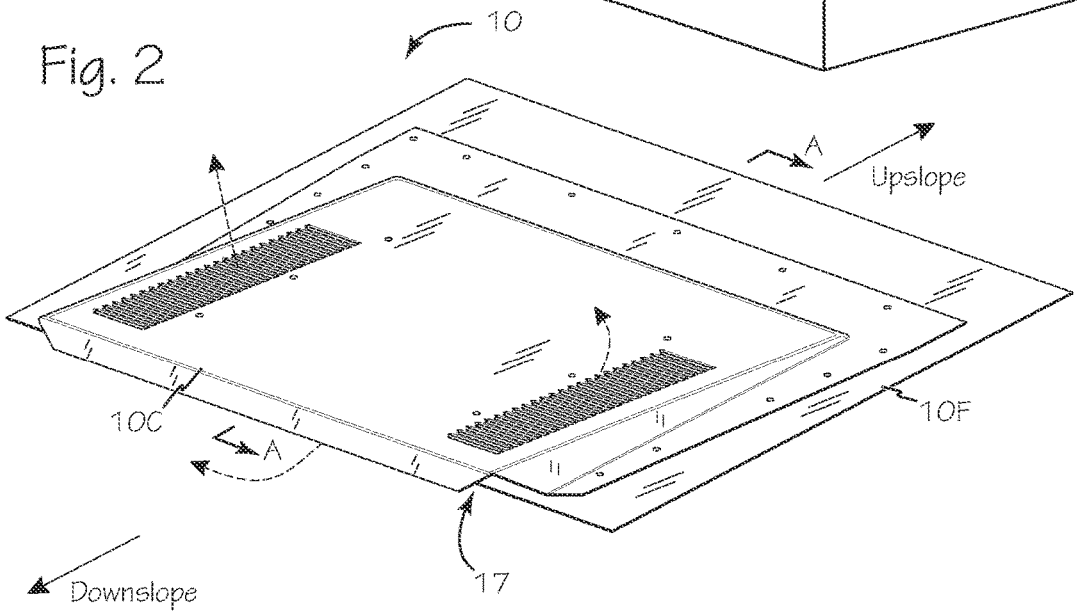
FIG. 2 is a perspective view of a low profile roof vent suitable for use on the building of FIG. 1.
Figure 3:
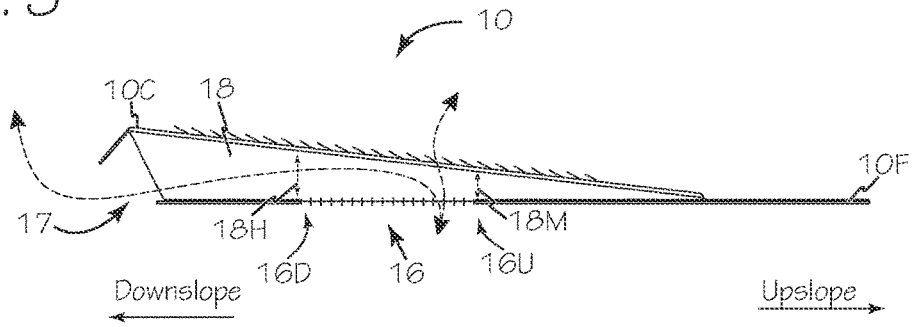
FIG. 3 is a cross section view of the vent of FIG. 2 taken along A-A.
Figure 4:
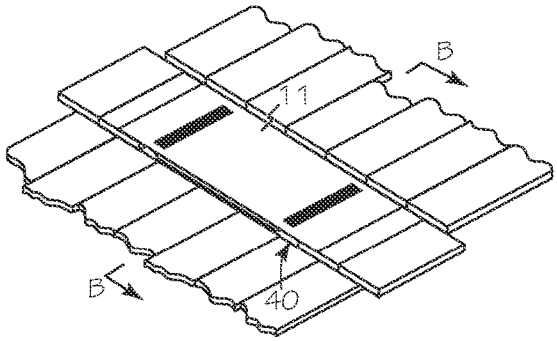
FIG. 4 is a perspective view of a flat tile roof with a shape matching vent.
Figure 5:
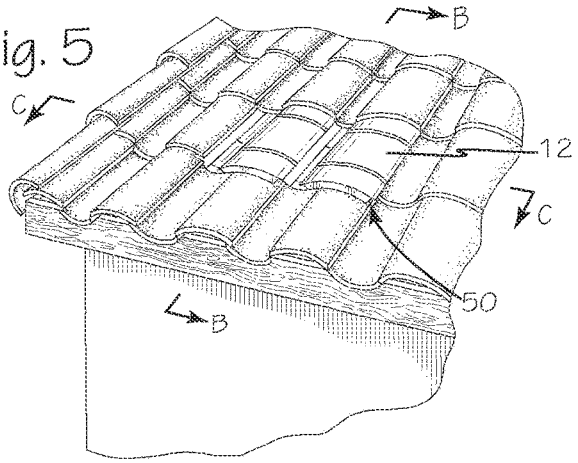
FIG. 5 is a perspective view of an S-type tile roof with a shape matching vent.
Figure 6:
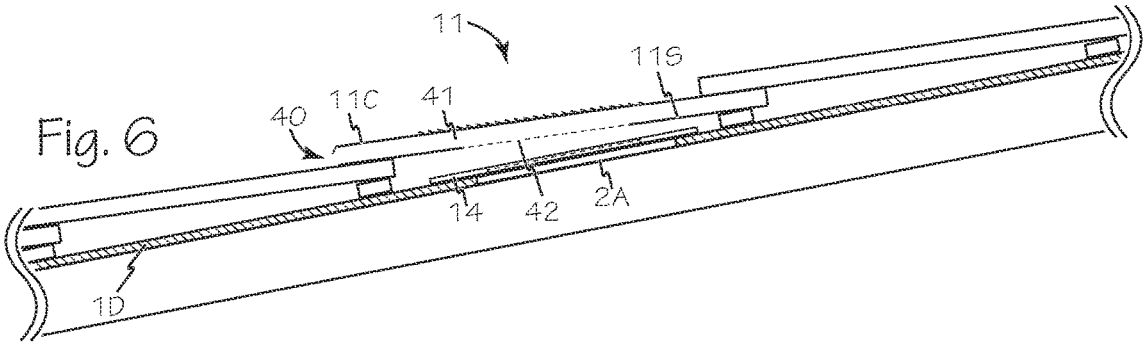
FIG. 6 is a cross section view of the vent of FIG. 4 taken along B-B.
Figure 7:
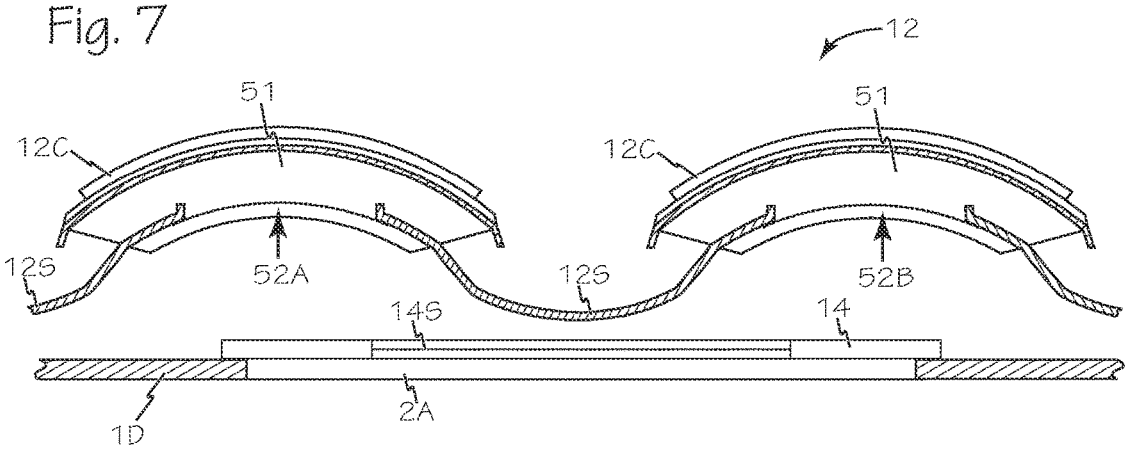
FIG. 7 is a cross section view of the vent of FIG. 5 taken along C-C.
Figure 17:
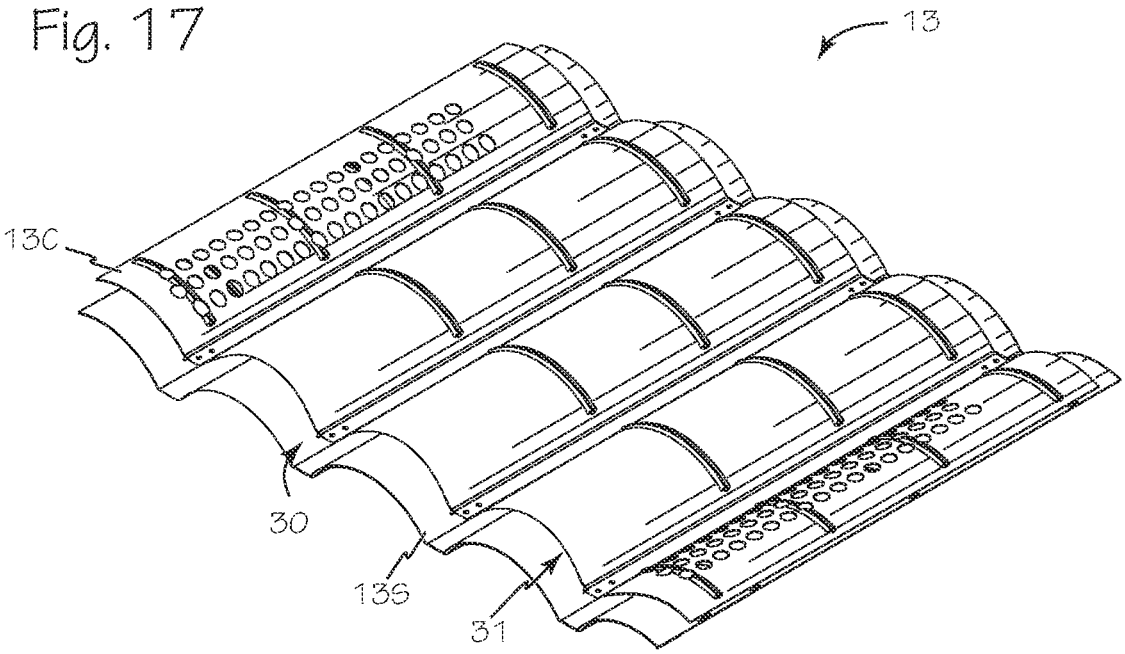
FIG. 17 is a top perspective view of an M-type secondary vent.
Figure 18:
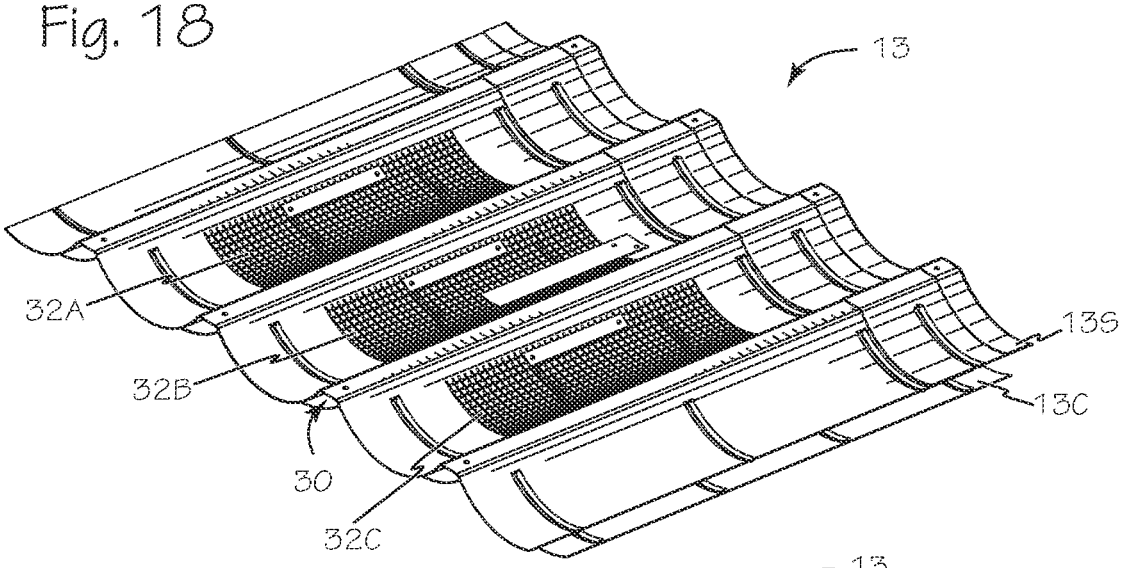
FIG. 18 is a bottom perspective view of the vent of FIG. 14.
Figure 19:
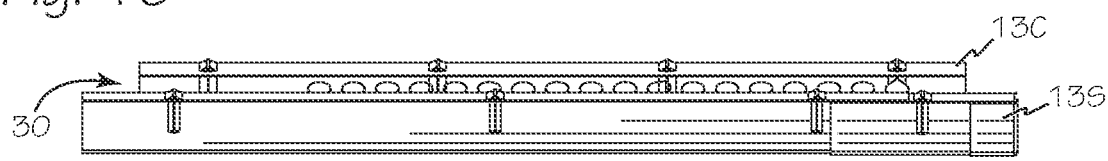
FIG. 19 is a side view of the vent of FIG. 14.
Figure 20:
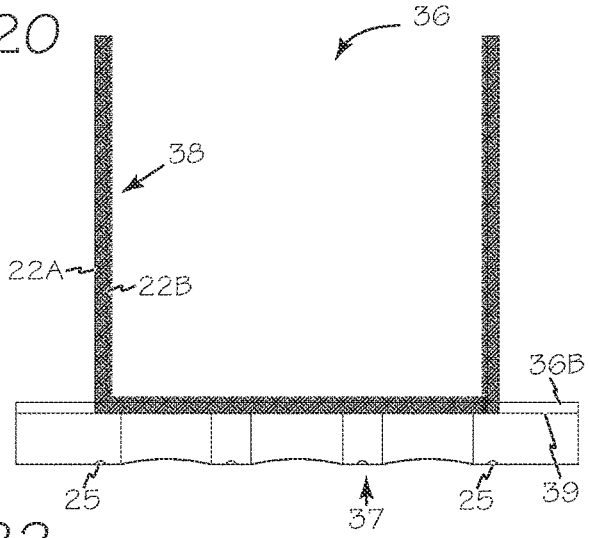
FIG. 20 is a top view of a flame, ember and rain resistant vent insert for an existing M-type roof vent.
Figure 22:
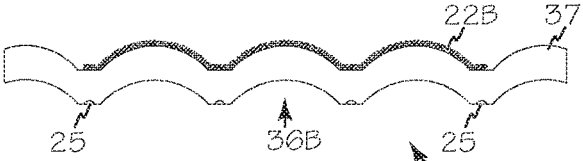
FIG. 22 is a front view of the flame, ember and rain resistant vent insert of FIG. 20.
Figure 23:
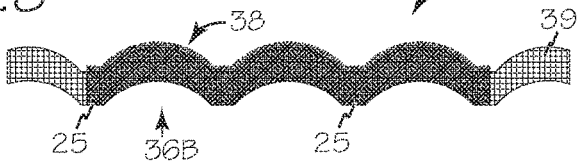
FIG. 23 is a back view of the flame, ember and rain resistant vent insert of FIG. 20.
Figure 24:
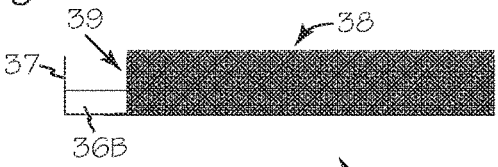
FIG. 24 is a left side view of the flame, ember and rain resistant vent insert of FIG. 20.
Figure 24:
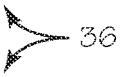
Figure 25:
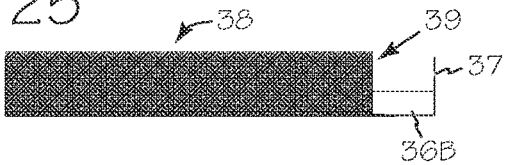
FIG. 25 is a right side view of the flame, ember and rain resistant vent insert of FIG. 20.
Figure 21:
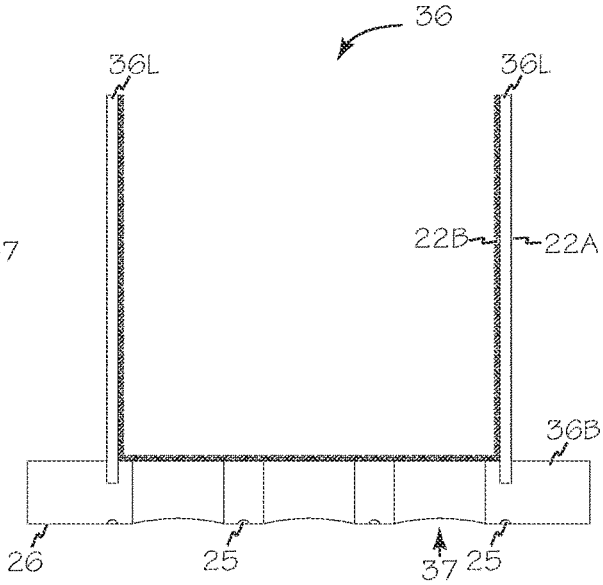
FIG. 21 is a bottom view of the flame, ember and rain resistant vent insert of FIG. 20.
Figure 26:
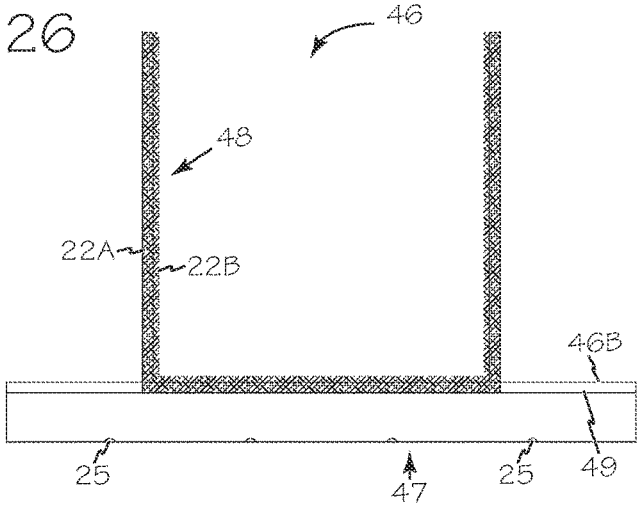
FIG. 26 is a top view of a flame, ember and rain resistant vent insert for an existing roof vent for flat clay and concrete tile.
Figure 28:
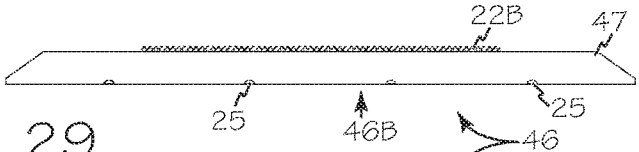
FIG. 28 is a front view of the flame, ember and rain resistant vent insert of FIG. 26.
Figure 29:
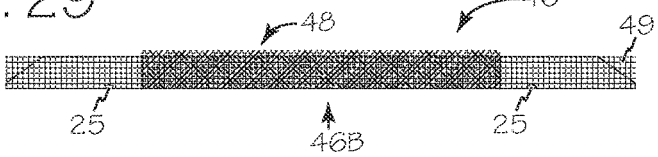
FIG. 29 is a back view of the flame, ember and rain resistant vent insert of FIG. 26.
Figure 30:
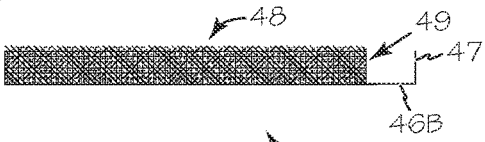
FIG. 30 is a left side view of the flame, ember and rain resistant vent insert of FIG. 26.
Figure 31:
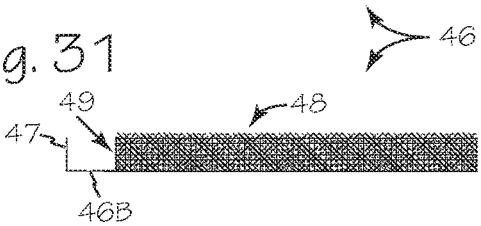
FIG. 31 is a right side view of the flame, ember and rain resistant vent insert of FIG. 26.
Figure 27:
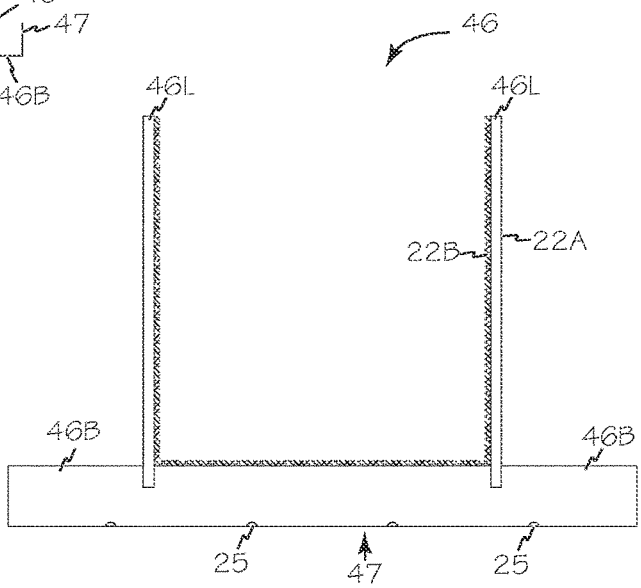
FIG. 27 is a bottom view of the flame, ember and rain resistant vent insert of FIG. 26.
Figure 32:
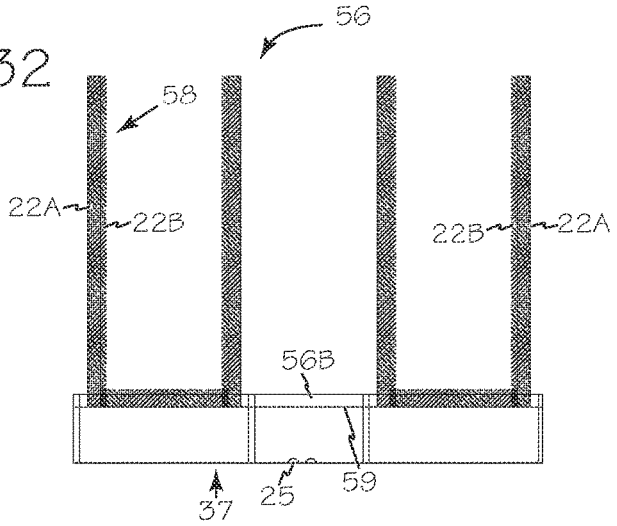
FIG. 32 is a top view of a flame, ember and rain resistant vent insert for an existing roof vent for S-type clay and concrete tile.
Figure 34:
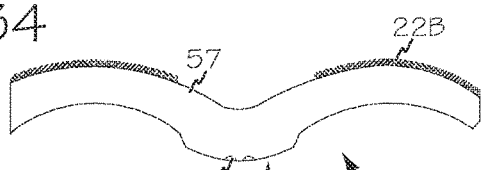
FIG. 34 is a front view of the flame, ember and rain resistant vent insert of FIG. 32.
Figure 35:
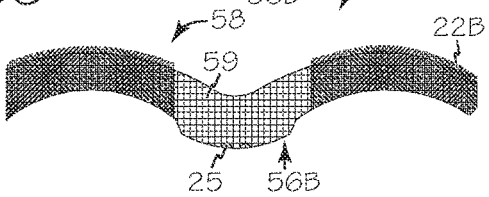
FIG. 35 is a back view of the flame, ember and rain resistant vent insert of FIG. 32.
Figure 36:
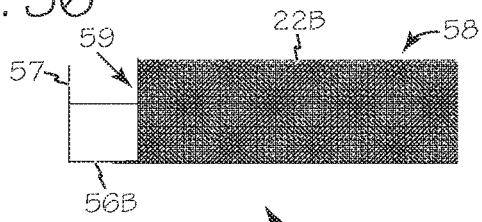
FIG. 36 is a left side view of the flame, ember and rain resistant vent insert of FIG. 32.
Figure 37:
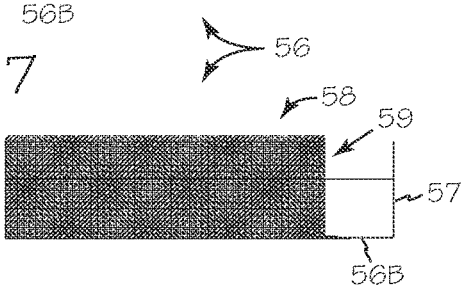
FIG. 37 is a right side view of the flame, ember and rain resistant vent insert of FIG. 32.
Figure 33:
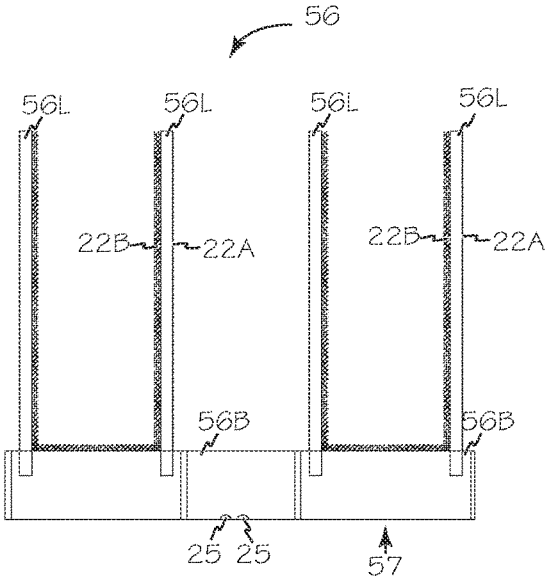
FIG. 33 is a bottom view of the flame, ember and rain resistant vent insert of FIG. 32.

The ventilation apertures 2A-2H are protected by any suitable vent cover such as the low profile vent 10 of FIGS. 2 and 3 which is suitable for use with shingle, slate or shake roofs, flat tile vent 11 of FIGS. 4 and 6 which is suitable for use with flat clay or concrete roof tiles, S-type vent 12 of FIGS. 5 and 7 which is suitable for use with S-type clay or concrete roof tiles and M-type vent 13 of FIGS. 17, 18 and 19 which is suitable for use with S-type clay or concrete roof tiles.

The low profile vent 10 of FIGS. 2 and 3 has vent flashing 10F secured to the roof deck 1D and is oriented with vent opening 16 in fluid communication with the ventilation aperture through the roof decking such as one of ventilation apertures 2A-2H. Vent 10 includes a downslope vent opening 17 in fluid communication with vent cavity 18, between flashing 10F and vent cover 10C, as well as vent opening 16. Vent cavity 18 has an internal height of 18H at the downslope edge 16D of vent opening 16 and minimum internal height 18M at the upslope edge 16U of vent opening 16.

Figure 8:
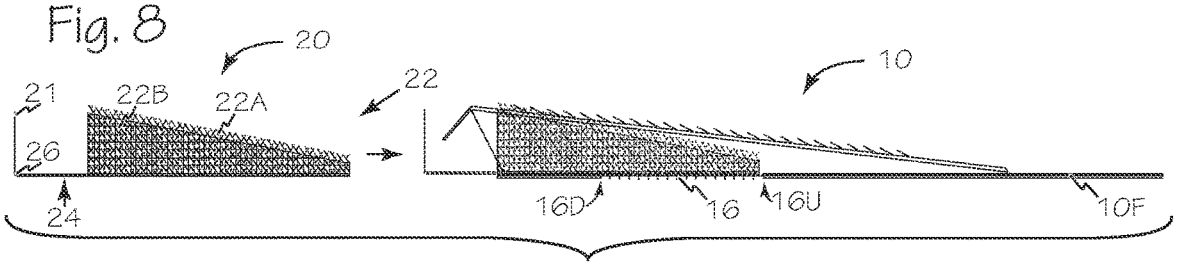
FIG. 8 is a side view of a low-profile roof vent and low profile vent insert.
Figure 9:
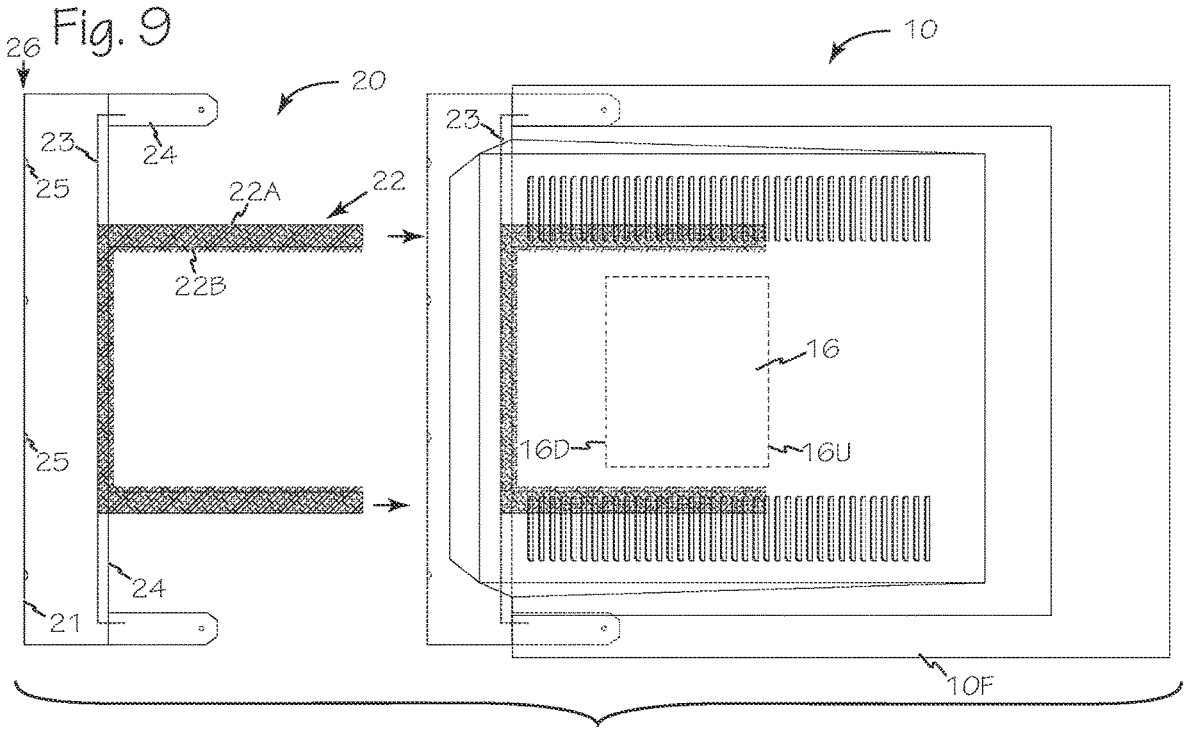
FIG. 9 is a top view of the low-profile roof vent and low profile vent insert of FIG. 8.

Vents 10, 11, 12 and 13 and any other suitable vent installed on a roof may be updated to provide extreme weather protection as well as fire and ember protection by the insertion of an appropriate vent insert, such as low profile vent insert 20 illustrated in FIGS. 11 through 16, which may be inserted in vent cavity 18 of low-profile vent 10 through the downslope opening 17 and then secured to the vent, surrounding roofing and or roof deck using any suitable fasteners and or caulking or mastic as illustrated in FIGS. 8 and 9.

Flame, ember and rain resistant vent inserts for each style vent include one or more of each optional elements discussed below which are formed from, or secured to insert base or frame 24 which is shaped to conform to the shape of the vent sub-flashing or vent skeleton. For example, each vent insert, such as flame, ember and rain resistant low profile vent insert 20, may include an external diverter 21 with weep holes, an internal filter 22, a downslope filter 23 to provide a general filter for downslope vent openings such as downslope vent opening 17 of low profile vent 10. Internal filter 22 includes one or both of a screen 22A to perform gross filtering and or filter mesh 22B which provides fine filtration and filters and prevents passage of embers and other solids. Internal filter 22 is sized to surround at least 3 sides of vent opening 16 and to span the internal height 18H at the downslope edge 16D and compress to fit in minimum internal height 18M at the upslope edge 16U.

Insertion of a vent insert, such as vent insert 20, is performed by orienting insert base 24 parallel to, and co-planer with, sub-flashing 10F with the internal filter 22 between the downslope vent opening 17 and the external diverter 21. The vent insert 20 is pushed into the downslope vent opening with internal filter 22 leading as illustrated in FIGS. 8 and 9. Vent insert 20 is inserted until downslope filter 23 obstructs downslope vent opening 17 and the external diverter remains outside the downslope vent opening. Once fully inserted, the vent insert is secured to the roof deck or to the vent skeleton as appropriate.

Figure 15:
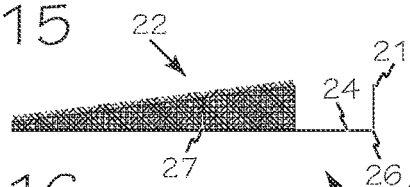
FIG. 15 is a left side view of the flame, ember and rain resistant vent insert of FIG. 11.
Figure 16:
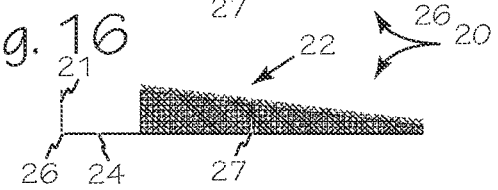
FIG. 16 is a right side view of the flame ember and rain resistant vent insert of FIG. 11.
Figure 12:
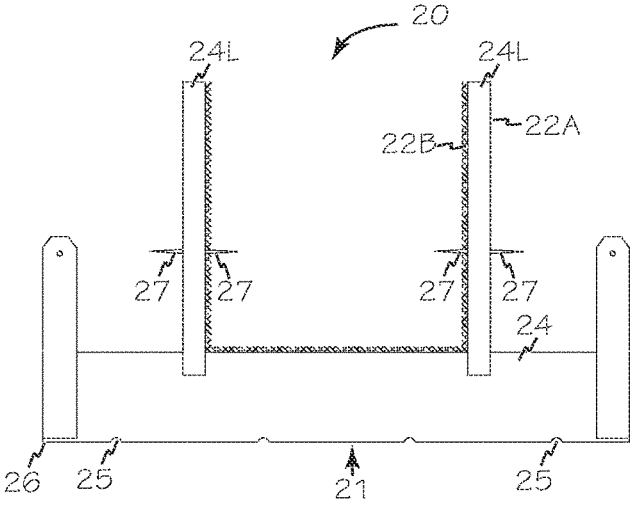
FIG. 12 is a bottom view of the flame, ember and rain resistant vent insert of FIG. 11.

The separate components of filter 22, screen 22A and filter mesh 22B are secured to and supported by insert base 24. Screen 22A and filter mesh 22B are secured to insert base filter legs 24L, 36L, 46L and 56L using any suitable material or technique, including without limitation adhesion, welding, fastening, wrapping, stitching and the like. The insert base filter legs, such as filter legs 24L, 36L, 46L and 56L, may optionally include one or more tabs, fingers or other elements extending from the filter leg such as filter fingers 27 which may be folded to engage either or both of screen 22A and filter mesh 22B as illustrated in FIGS. 12, 15 and 16. Downslope filter 23 and screen 22A are any suitable ventilation screen such as ¼" steel mesh although any suitable material and mesh size may be used such as ⅛" mesh made of stainless steel, brass, copper, plastic, intumescent material or other. Filter mesh 22B is a flame-resistant interwoven mesh which may be any suitable material such as stainless steel. In a preferred configuration, filter mesh 22B is stainless steel wool made from alloy type AISI 434 stainless steel which forms a pad approximately ¼" thick. Filter mesh 22B is secured to screen 22A and/or insert base 24.

External diverter 21 spans all or a significant portion of the horizontal expanse of downslope vent opening 17 to prevent direct flow of fire, flame, embers and wind driven rain or other material into downslope vent opening 17. Each external diverter, such as external diverter 21, has one or more weep holes, such as weep holes 25 to prevent water retention by the external diverter. The weep holes, such as weep holes 25 are arranged along, and span, the intersection of external diverter 21 and insert base 24, known as drain line 26. Weep holes, such as weep holes 25, may adopt any suitable shape such as a closed curve, any suitable polygon, heart shape, star shape, triangle shape and the like.

Vent insert 20 may include only insert base 24 and external diverter 21; or vent insert 20 may include only insert base 24 and downslope filter 23; or vent insert 20 may include insert base 24 and screen 22A; or vent insert 20 may include or insert base 24 and filter mesh 22B. Alternatively, vent insert 20 may include any suitable combination of external diverter 21, downslope filter 23, screen 22A and or filter mesh 22B. A vent insert such as vent insert 20 with at least screen 22A and or filter mesh 22B may include one or more tabs, fingers or other elements extending from the filter leg of the vent insert such as filter fingers 27 to engage either or both of screen 22A and or filter mesh 22B.

Figure 10:
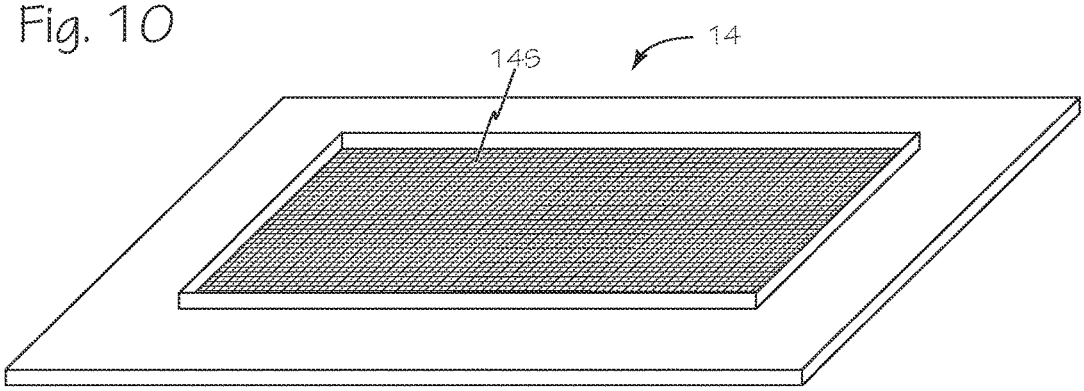
FIG. 10 is a perspective view of a primary vent.
Figure 11:
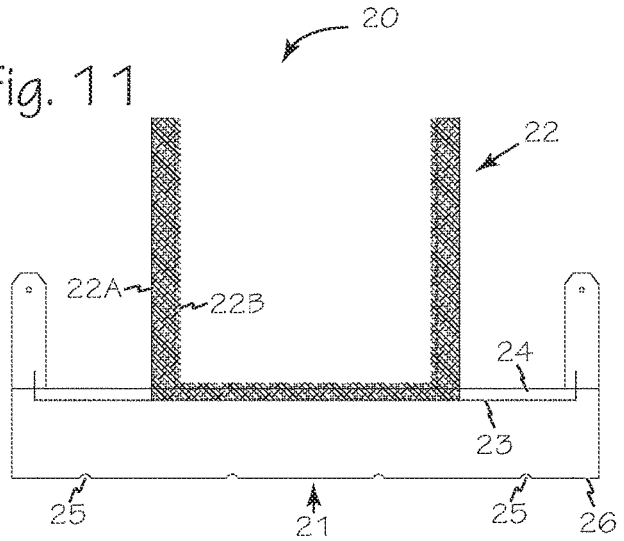
FIG. 11 is a top view of a flame, ember and rain resistant vent insert for an existing roof vent.
Figure 13:
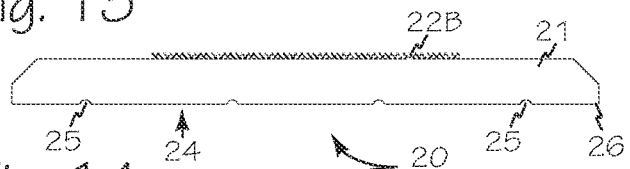
FIG. 13 is a front view of the flame, ember and rain resistant vent insert of FIG. 11.
Figure 14:
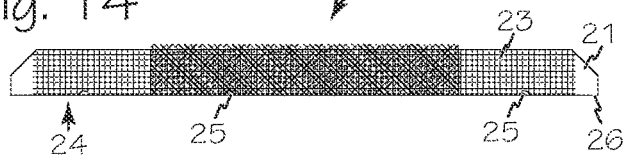
FIG. 14 is a back view of the flame, ember and rain resistant vent insert of FIG. 11.

Two-piece vents, such as flat tile vent 11, S-type vent 12 or M-type vent 13, include a primary vent 14 as illustrated in FIGS. 6, 7 and 10. Primary vent 14 includes any suitable insect/vermin and debris barrier, such as screen 14S, and is installed on a roof deck, such as deck 1D of FIG. 1, over a ventilation opening or aperture, such as ventilation apertures 2A-2H, cut through the deck.

Referring now to FIGS. 17, 18 and 19, M-type vent 13 has a skeleton 13S parallel to cap 13C. The orientation of skeleton 13S and cap 13C create a downslope vent opening 30 in fluid communication with vent cavity 31 formed between skeleton 13S and cap 13C. Skeleton 13S includes secondary ventilation openings 32A, 32B and 32C.

M-type vent insert 36 is illustrated in FIGS. 20 through 25. Vent insert 36 includes an insert base 36B and may be inserted in vent cavity 31 of low-profile vent 10 through the downslope opening 30 and insert base 36B is secured to the vent skeleton 13S using any suitable fasteners and or caulking or mastic. M-type vent insert 36 includes an external diverter 37 with weep holes 25, internal filter 38 and a downslope filter 39 to provide a general filter for downslope vent openings such as downslope vent opening 30 of M-type vent 13. Internal filter 38 is sized to surround at least three sides of a portion of vent cavity 31 composed of the space between secondary ventilation openings 32A, 32B and 32C and vent cap 13C. Internal filter 38 is composed of a screen 22A for structure and filter mesh 22B to filter and prevent passage of embers and other solids into secondary ventilation openings 32A, 32B and 32C. Internal filter 38 is sized to span the distance between skeleton 13S and vent cap 13C.

Flat tile vent 11 of FIGS. 4 and 6 has a skeleton 11S parallel to cap 11C. The orientation of skeleton 11S and cap 11C create a downslope vent opening 40 in fluid communication with vent cavity 41 formed between skeleton 11S and cap 11C. Skeleton 11S includes a secondary ventilation opening 42.

Flat tile vent insert 46 is illustrated in FIGS. 26 through 31. Vent insert 46 includes an insert base 46B and may be inserted in vent cavity 41 of flat tile vent 11 through the downslope opening 40 and insert base 46B is secured to the vent skeleton 11S using any suitable fasteners and or caulking or mastic. Flat tile vent insert 46 includes an external diverter 47 with weep holes 25, internal filter 48 and a downslope filter 49 to provide a general filter for downslope vent openings such as downslope vent opening 40 of flat tile vent 11. Internal filter 48 is sized to surround at least three sides of a portion of vent cavity 41 composed of the space between secondary ventilation opening 42 and vent cap 11C. Internal filter 48 is composed of a screen 22A for structure and filter mesh 22B to filter and prevent passage of embers and other solids into secondary ventilation opening 42. Internal filter is sized to span the distance between skeleton 11S and vent cap 11C.

S-type vent 12 of FIGS. 5 and 7 has a skeleton 12S parallel to cap 12C. The orientation of skeleton 12S and cap 12C create a downslope vent opening 50 in fluid communication with vent cavity 51 formed between skeleton 12S and cap 12C. Skeleton 12S includes first and second secondary ventilation openings 52A and 52B.

S-type vent insert 56 is illustrated in FIGS. 32 through 37. Vent insert 56 includes an insert base 56B and may be inserted in vent cavities 51 of S-type tile vent 12 through the downslope opening 50 and insert base 56B is secured to the vent skeleton 12S using any suitable fasteners and or caulking or mastic. S-type vent insert 56 includes an external diverter 57 with weep holes 25, first internal filter 58A, second internal filter 58B and a downslope filter 59 to provide a general filter for downslope vent openings such as downslope vent opening 50 of flat tile vent 12. Each of first and second internal filters 58A and 58B are sized to surround at least three sides of a portion of vent cavity 51 composed of the space between first or second secondary ventilation openings 52A and 52B respectively and vent cap 12C. Internal filters 58A and 58B are composed of a screen 22A for structure and filter mesh 22B to filter and prevent passage of embers and other solids into first and second secondary ventilation openings 52A and 52B. Internal filters 58A and 58B are sized to span the distance between skeleton 12S and vent caps 12C.

Flame, ember and rain resistant vent inserts, such as vent inserts 20, 36, 46 and 56, may also be removable from the permanent vent installed on a roof. Removing a previously installed flame, ember and rain resistant vent insert may enable the replacement of clogged or damaged elements such as screens or intumescent screens that have been exposed to extreme heat or to add additional features not include on the originally installed vent insert.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

We claim:

1. An improved ventilation system for a building, the building having a roof deck with one or more ventilation apertures therethrough and a layer of roof shingles attached to the roof deck and one or more roof vents interspersed among the roof shingles, each of the one or more roof vents having an upslope edge, a downslope edge, a vent cover secured to a sub-flashing forming a vent cavity therebetween and a downslope vent opening along the downslope edge of the one or more roof vents, the sub-flashing including a ventilation opening in fluid communication with at least one of the one or more ventilation apertures, the vent cavity and the downslope vent opening, the improved ventilation system comprising:

a flame, ember and rain resistant vent insert operable to be inserted through the downslope vent opening of one of the one or more roof vents and secured to the roof deck and or the one or more roof vents, comprising:

a generally planar insert base;

an external diverter oriented perpendicular to and intersecting the generally planar insert base along a drain line;

a plurality of weep holes, through the generally planar insert base and the external diverter, intersecting the drain line;

an internal filter having a structural screen combined with a filter mesh, the internal filter is sized to surround at least 3 sides of the ventilation opening and to span the vent cavity from the vent cover to the sub-flashing; and a downslope filter operable to obstruct the downslope vent opening.

2. A flame, ember and rain resistant vent insert for a roof vent having a downslope vent opening, a vent cavity and one or more secondary vent openings in fluid communication with the vent cavity and the downslope vent opening, the flame, ember and rain resistant vent insert comprising: an insert base with a plurality of filter legs extending therefrom; and at least one of an external diverter, an internal filter or a downslope filter secured to the insert base with the plurality of filter legs.

3. The flame, ember and rain resistant vent insert of claim 2 wherein the insert base with the plurality of filter legs extending therefrom includes an attached said external diverter oriented perpendicular to and intersecting the insert base along a drain line and a plurality of weep holes, through the insert base and the external diverter, intersecting the drain line; and at least one of the internal filter or the downslope filter.

4. The flame, ember and rain resistant vent insert of claim 2 wherein the insert base with the plurality of filter legs extending therefrom includes an attached said internal filter secured to the filter legs and to the insert base and to one of the downslope filter or the external diverter; and the internal filter is sized to surround at least 3 sides of each of the one or more secondary ventilation openings and to span the vent cavity from a vent cap to a skeleton.

5. The flame, ember and rain resistant vent insert of claim 4 wherein the internal filter is comprised pf at least one of a structural screen or a filter mesh.

6. The flame, ember and rain resistant vent insert of claim 4 wherein the internal filter is comprised of a structural screen and a filter mesh.

7. The flame, ember and rain resistant vent insert of claim 2 wherein the insert base with the plurality of filter legs extending therefrom includes an attached said downslope filter operable to obstruct the downslope vent opening and the internal filter formed of a structural screen sized to surround at least 3 sides of each of the one or more secondary vent openings and to span the vent cavity from a vent cap to a skeleton.

8. The flame, ember and rain resistant vent insert of claim 2 wherein the insert base with the plurality of filter legs extending therefrom includes an attached said downslope filter operable to obstruct the downslope vent opening and the internal filter formed of a filter mesh sized to surround at least 3 sides of each of the one or more secondary vent openings and to span the vent cavity from a vent cap to a skeleton.

9. The flame, ember and rain resistant vent insert of claim 2 wherein the insert base with the plurality of filter legs extending therefrom includes an attached said downslope filter operable to obstruct the downslope vent opening and the internal filter formed of a structural screen and a filter mesh sized to surround at least 3 sides of each of the one or more secondary vent openings and to span the vent cavity from a vent cap to a skeleton.

10. The flame, ember and rain resistant vent insert of claim 2 wherein the roof vent includes a sub-flashing and the insert base is generally planar.

11. The flame, ember and rain resistant vent insert of claim 2 wherein the roof vent includes a skeleton and the insert base corresponds to the shape of the skeleton.

12. The flame, ember and rain resistant vent insert of claim 11 wherein the roof vent is a flat tile vent.

13. The flame, ember and rain resistant vent insert of claim 11 wherein the roof vent is an M-type vent.

14. The flame, ember and rain resistant vent insert of claim 11 wherein the roof vent is an S-type vent.

15. The flame, ember and rain resistant vent insert of claim 2 wherein the roof vent is a low profile vent with a sub-flashing.

16. An improved ventilation system for a roof having a roof deck, at least one ventilation aperture therethrough and a layer of roof shingles attached to the roof deck and at least one roof vent having an upslope edge, a downslope edge, a vent cover secured to a sub-flashing forming a vent cavity therebetween and a downslope vent opening along the downslope edge of the at least one roof vent, the sub-flashing having a ventilation opening in fluid communication with the at least one ventilation aperture, the vent cavity and the downslope vent opening, the improved ventilation system comprising:

a flame, ember and rain resistant vent insert operable to be inserted through the downslope vent opening of one of the at least one roof vents and secured to the roof deck and or the at least one roof vent, comprising:

a generally planar insert base; an external diverter oriented perpendicular to and intersecting the generally planar insert base along a drain line;

a plurality of weep holes, through the generally planar insert base and the external diverter, intersecting the drain line;

an internal filter having a structural screen combined with a filter mesh, the internal filter is sized to surround at least 3 sides of the ventilation opening and to span the vent cavity from the vent cover to the sub-flashing; and a downslope filter operable to obstruct the downslope vent opening.

* * * * *